US005182175A

United States Patent [19]

Sakaki et al.

[11] Patent Number: 5,182,175

[45] Date of Patent: Jan. 26, 1993

[54] RECORDING MEDIUM

[75] Inventors: Mamoru Sakaki, Sagamihara; Tomomi Nakatsugawa, Kawasaki; Hiroshi Sato, Yokohama, all of Japan

[73] Assignee: Canon Kabushiki Kaisha, Tokyo, Japan

[21] Appl. No.: 503,741

[22] Filed: Apr. 3, 1990

[30] Foreign Application Priority Data

Apr. 3, 1989 [JP] Japan ..... 1-85192

[51] Int. Cl.[5] ..... B41M 5/00

[52] U.S. Cl. ..... 428/537.5; 346/135.1; 428/195; 428/206; 428/211; 428/329; 428/364

[58] Field of Search ..... 428/195, 211, 537.5, 428/364, 206, 329; 346/135.1

[56] References Cited

U.S. PATENT DOCUMENTS 4,965,612 10/1990 Sakaki et al. ..... 346/1.1

FOREIGN PATENT DOCUMENTS 0331125 6/1989 European Pat. Off. ..... 428/195
54-59936 5/1979 Japan ..... 346/1.1
56-84992 7/1981 Japan ..... 346/1.1
56-99693 8/1981 Japan ..... 346/1.1
59-20696 2/1984 Japan ..... 428/195
59-33176 2/1984 Japan ..... 428/195
60-257286 12/1985 Japan ..... 428/195
61-58788 3/1986 Japan ..... 428/195

OTHER PUBLICATIONS

Abstract Bulletin of the Institute of Paper Chemistry, vol. 57, No. 4, p. 601, Abstract No. 5353, Oct. 1986.
Abstract Bulletin of the Institute of Paper Chemistry, vol. 57, No. 5, p. 717, Abstract No. 6381, Nov. 1986.

*Primary Examiner*—Pamela R. Schwartz
*Attorney, Agent, or Firm*—Fitzpatrick, Cella, Harper & Scinto

[57] ABSTRACT

A recording medium comprises a substrate, and an ink-receiving layer provided thereon wherein the ink receiving layer contains water-insoluble and amorphous basic aluminum salt. The recording medium according to claim 1, the basic aluminum salt is represented by the general formula (1) below:

$$Al_x(OH)_yX_z \quad (1)$$

where x, y, and z are respectively positive integers and satisfy the relations of $z=3x-y$, and $x/z \geqq 3$, and X is an acid radical.

9 Claims, No Drawings

RECORDING MEDIUM

BACKGROUND OF THE INVENTION

1. Field of the Invention

The present invention relates to a recording medium (or recording paper) for recording with ink, particularly to a recording medium superior in ink color developing properties and capable of forming a water-resistant recorded image with high resolution. The present invention also relates to a recording method using the recording medium.

2. Related Background Art

Recording mediums for ink jet recording hitherto known are: (1) those of low-sized paper made from pulp as the main constituent, in a form like filter paper and blotting paper: (2) those constituted of base paper exhibiting low ink absorbency, and an ink-receiving layer provided thereon by use of porous inorganic pigment; and the like.

On the other hand, in ink jet recording for forming color images of high quality with high resolution, recording mediums to be employed are required to satisfy the requisites as below: (1) Satisfactory color development of ink applied to the recording medium, (2) Substantially complete circularity of an ink dot, (3) Sufficient ink absorbing capacity for preventing ink from flowing out even when a plurality of ink droplets are attached to the same spot, (4) Sufficient ink fixing property to prevent running of ink even when an ink droplet is rubbed immediately after application of ink to the recording medium, (5) Satisfactory preserving property for formed images such as water-resistance and light-fastness.

No recording medium, however, has been known which satisfies all the requisites mentioned above.

In particular, in ink jet recording, since it uses aqueous ink, there are posed problems that the recorded image has low water-resistance, and thus that decipherment of the image becomes very difficult because of blurring of ink when the image is wetted with water. These problems are required to be solved.

The ink-jet recording paper disclosed in Japanese Patent Application Laid-open No. 56-99693 (1981), for example, employs quaternary ammonium halide to improve water-resistance. Such water-resistant ink-jet recording paper involves the disadvantage of remarkable decrease of light-fastness of a recording agent (e.g., dyes).

Water-resistance improving agents for image, having specified constitutions, are disclosed in Japanese Patent Application Laid-open Nos. 56-84992, 59-20696, 59-33176, and 61-58788. Each of these water-resistance improving agents has a primary, secondary or tertiary amino group, or a quaternary ammonium group, so that the light-fastness of the ink-jet-recorded images is not sufficient even though water resistance is sufficient.

Since dyes used in ink-jet recording are anionic in the prior art, an amine type compound is incorporated as a water-resistance improving agent into an ink-jet recording medium. However, the addition of such an amine type compound lowers disadvantageously light-fastness of images, and even with various improvements, lowering or decrease of the light-fastness cannot be avoided.

An example of a recording medium employing a water-resistance improving agent other than amine type compounds is disclosed in Japanese Patent Application Laid-open No. 60-257286. In this disclosure, a basic polyaluminum hydroxide compound is used as a water-resistance improving agent. According to the knowledge of the inventors, the compound shown in the Japanese Patent Application Laid-open No. 60-257286 is a water-soluble polycationic compound, which is not sufficient for imparting water-resistance to a recording medium where a large quantity of dye is incorporated into a recording medium to give an image in high definition and high concentration.

As mentioned above, no satisfactory measure has been found for achieving simultaneously water-resistance and light-fastness of an ink-jet-recorded image.

SUMMARY OF THE INVENTION

An object of the present invention is to provide a recording medium suitable for ink-jet recording, which meets the aforementioned requisites and particularly gives a water-resistant, light-fast image.

Another object of the present invention is to provide a recording medium which improves color development of ink and gives an image excellent in color development property A further Object of the present invention is to provide a recording method employing the recording medium.

The above objects have been achieved by the present invention as below.

According to one aspect of the present invention, there is provided a recording medium, comprising a substrate, and an ink-receiving layer provided thereon, the ink-receiving layer containing a water-insoluble and amorphous basic aluminum salt.

According to another aspect of the present invention, there is provided a recording medium comprising a base paper and a pigment layer provided thereon, the pigment layer containing a water-insoluble and amorphous basic aluminum salt, and the recording medium having a Stöckigt sizing degree of from zero to 15 seconds.

According to a further object of the present invention, there is provided a recording method, comprising applying ink droplets containing an acid dye and/or a direct dye onto a recording medium, the recording medium containing a water-insoluble and amorphous basic aluminum salt in the surface layer of the recording medium.

DETAILED DESCRIPTION OF THE PREFERRED EMBODIMENT

The present invention provides a recording medium which gives an image superior in color development property, colorfulness and water-resistance of the image by incorporation of water-insoluble amorphous basic aluminum salt into an ink-receiving layer on a substrate.

The basic aluminum salt in the present invention is a compound represented by the general formula (1) below:

$$Al_x(OH)_yX_z \quad (1)$$

where X is an acid radical. Specifically the compound is a basic aluminum salt of hydrochloric acid, nitric acid, acetic acid, formic acid, oxalic acid, sulfamic acid, lactic acid, or the like.

The primary feature of the present invention is that the ink-receiving layer contains a water-insoluble basic aluminum salt. Within the knowledge of the inventors of the present invention, sufficient water-resistance and light-fastness in recorded images with high definition and high density could not be achieved without the use of the water-insoluble basic aluminum salt.

The solubility of the above compound is generally adjustable by the molar ratio of Al and the acid radical X. The compound of the formula (1) is insoluble when $z=3x-y$, and $x/z$ is 3 or more.

In the above-mentioned basic aluminum salt of the general formula, $Al_x(OH)_yCl_{3x-y}$, for example, the lower compounds up to $Al_2(OH)_5Cl$ are water-soluble polycationic substance existing in a water solution, while the compounds $Al_3(OH)_8Cl$ or higher are water-insoluble and are colloidal substances polymerized.

On the other hand, the viscosity of the above-mentioned colloidal solution (sol) tends to rise with the increase of $x/z$ ratio. Accordingly, the most suitable basic aluminum salt in the present invention has the structure of $Al_3(OH)_8X$, and the polymer thereof constitutes mainly the particles.

Such particles per se are obtained as a colloidal material by heating and dissolving aluminum powder in a solution of an acid having the above-mentioned anion capable of forming a salt with aluminum, namely hydrochloric acid, acetic acid, nitric acid etc., or otherwise by heating and dissolving aluminum powder in a solution of an aluminum salt such as aluminum chloride, basic aluminum chloride, etc.

The basic aluminum salt particles of the present invention is usually in a form of an aggregate of bar-shaped particles of several ten nm×several hundred nm.

The molar ratio of aluminum particles to the acid is preferably in the range of approximately from 10/1 to ½, and normally selected depending on the molar ratio of Al and X of the desired compound. The heating and dissolving are normally practiced at a temperature in the range of from 80° to 140 ° C. for the time of from 1 to 24 hours.

The colloidal particles obtained should essentially be a non-crystalline amorphous basic aluminum salt.

The treatment of the particles at a higher temperature gives boehmite (AlOOH), or particulate $\gamma$- or $\alpha$-type alumina, which does not give sufficient water-resistance.

In the present invention, ineffective and unsuitable are: alumina sol of $\gamma$-$Al_2O_3$·$H_2O$ type which is prepared by adding an alkali to an aluminum salt; alumina sol of boehmite type which is obtained by treatment of sodium aluminate solution with aluminum sulfate and subsequent heating of resulting aluminum hydroxide in an autoclave; or ultra-fine particles of $\gamma$-alumina obtained by a vapor phase method or a Bayer method.

The recording medium of the present invention, which employs a water-insoluble amorphous basic aluminum salt as described above, gives unprecedentedly excellent water-resistance and light-fastness of the recorded image.

For further improvement of light-fastness of the recorded image in the present invention, the acid radical in Formula (1) is preferably an organic acid radical.

The more preferable embodiment of the present invention is described below.

The recording medium of the present invention comprises a base paper as a substrate, and a surface layer comprising a pigment and a binder.

The pigment is preferably cationic in the present invention for further improving water-resistance of a recorded image.

In this specification, the "cationic pigment" means a pigment exhibiting a positive zeta potential. Generally, a powdery material exhibiting a positive zeta potential readily adsorbs an anionic substance on its surface, which is considered to serve supplementarily as a water-resistance improving agent without impairing the basicity of the basic aluminum salt.

The specific examples of such pigments include aluminum oxide, aluminum hydroxide, magnesium oxide, magnesium hydroxide, basic magnesium carbonate, and the like.

The zeta potential mentioned above is a value derived from the potential generated upon allowing an electrolyte solution to flow through a powder layer (streaming potential) according to the formula below:

$$\zeta = \frac{4\pi\eta}{\epsilon} \cdot \frac{\lambda E}{P} \quad (3)$$

$\eta$: Viscosity coefficient of liquid
$\lambda$: Electroconductivity of liquid
$\epsilon$: Dielectric constant of liquid In the present invention, the zeta potential is based on the streaming potential generated by flow of 1/1000 N potassium chloride solution. The cationic pigment employed in the present invention has a BET specific surface area in the range of preferably from 20 to 170 $m^2/g$, more preferably from 40 to 170 $m^2/g$, still more preferably from 60 to 170 $m^2/g$. The BET specific surface area thereof below 20 $m^2/g$ causes insufficiency of ink absorbency, image density, and especially water-resistance, while the BET specific surface area above 170 $m^2/g$ poses another problem on fastness of indoor discoloration different from the light-fastness.

As far as the present inventors know, the single use of the water-insoluble basic aluminum salt mentioned above for the water-resistance-improving agent cannot give sufficient water-resistance yet in comparison with the use of the aforementioned amine type compound, although the light-fastness is satisfactory and the water-resistance is improved significantly in comparison with those achieved by the use of a water-soluble salt.

In the present invention, the water-resistance and light-fastness of the image is further improved by forming the surface layer mainly from a cationic pigment.

Particulate silica, which is used generally for forming coat layers of ink-jet recording medium, is not satisfactory for giving water-resistance to adsorbed dye, while the aforementioned cationic pigment has an effect of improving water-resistance of an acidic dye or a direct dye because of its cationic surface property.

Accordingly, in the present invention, the use of the water-insoluble basic aluminum salt and the cationic pigment in combination is desirable in order to attain more satisfactory water-resistance and light-fastness.

The quantity of the basic aluminum salt to be used is in the range of from 5 to 35 parts by weight, preferably from 8 to 30 parts by weight, still more preferably from 12 to 24 parts by weight per 100 parts by weight of the pigment.

The quantity of less than 5 parts by weight thereof will not give sufficient effect on water-resistance and light-fastness of the image, while the quantity above 35 parts by weight will lower the optical density of the image.

Other components which may be contained in the surface layer in the present invention include: water-soluble polymers such as starch, gelatin, casein, gum arabic, sodium alginate, carboxymethylcellulose, polyvinyl alcohol, polyvinylpyrrolidone, poly(sodium acrylate) and the like; synthetic resin latexes such as synthetic rubber latexes; organic-solvent-soluble resins such as polyvinylbutyral, polyvinyl chloride, and the like; and further various additives including dispersants, fluorescent dyes, pH-controlling agents, antifoaming agents, lubricants, antiseptic agents, surfactants, and the like.

A known pigment such as silica may be used in combination with the cationic pigment in the present invention. However, the cationic pigment is contained preferably at 40% or more by weight, more preferably 80% or more by weight in the materials constituting the pigment layer. The content Of less than 40% by weight will not give the sufficient effects of the cationic pigment.

The basic aluminum salt may be used mixedly with the aforementioned amine type water-resistance improving agent, where the amount of the amine type water-resistance improving agent is preferably not more than 70% by weight, more preferably not more than 25% by weight of the basic aluminum salt.

The amount above 70% by weight thereof undesirably gives adverse effect of the amine type water-resistance improving agent of lower light-fastness.

The ratio of the pigment and the binder is preferably in the range of from 10/1 to 1/3 by weight.

In the case where the aforementioned cationic pigment is used in the present invention, the recording medium preferably has the constitution show below since the ink absorbing ability of the particulate material per se is lower in comparison with particulate synthetic silica usually used for ink-jet recording.

That is, the recording medium preferably comprises the aforementioned surface layer, and a base material which has an ink-absorbing property.

The surface layer in the present invention is the layer constituting the recording face, which is not to absorb and retain the whole quantity of ink attached thereto, but serves to adsorb mainly the dye from the applied ink and allows the greater portion of the ink solvent to pass through the ink-absorbent base material.

Accordingly, the recording medium of the present invention includes an embodiment in which it has a recording face which is constituted of a pigment for constituting the surface layer and a fibrous material of the base paper, and an embodiment in which the surface layer of not more than 20 μm thick, preferably not more than 15 μm thick covers the recording face.

The preferable quantity of coating for the surface layer is in the range of from 0.3 to 7 g/m$^2$ of total pigments. A quantity of coating of less than 0.3 g/m$^2$ will not give effect of the coating in comparison with the case of no surface layer provided, while a quantity of coating of more than 7 g/m$^2$ or a maximum thickness of the surface layer of more than 20 μm poses problems of remarkable decrease of ink absorbency, occurrence of indoor discoloration, powdering of paper, and so on similarly to the case of the recording medium (2) described before, in particular in the case where the aforementioned particulate aluminum oxide is used.

A more preferable quantity of coating of pigment in the surface layer is in the range of from 1 to 7 g/m$^2$, still more preferably from 2 to 7 g/m$^2$ in the present invention.

The maximum thickness of the surface layer, in the present invention, is the largest thickness of the surface layer in the deepness direction in the cross-section of the recording medium, and the quantity of coating of pigment is the quantity of pigment applied as the surface layer. The quantity of coating of pigment is derived as a difference of the total ash content in the recording medium and the ash content of the base paper according to JIS-P-8128.

The base paper for providing the surface layer thereon is preferably ink-absorbent, and has a Stöckigt sizing degree preferably of from 0 to 15 seconds, more preferably from 0 to 10 seconds, still more preferably from 0 to 8 seconds. The Stöckigt sizing degree of the base paper of exceeding 15 seconds does not give sufficient ink absorbency to the entire recording medium, and is not desirable.

The sizing degree of the recording medium having the surface layer provided on the base paper is preferably in the range of from 0 to I5 seconds.

If the sizing degree exceeds 15 seconds, most of the ink absorption is to be conducted by the coating layer described above, which will cause insufficiency of ink absorbency.

The pulp for constituting the base paper in the present invention is not specifically limited. Usually conventional wood pulp such as LBKP and NBKP is used therefor. Glass fiber or synthetic fiber may be used with such wood pulp in combination, if desired.

The examples of the fillers for the base paper the present invention include generally used ones such as clay, talc, kaolinite, titanium oxide, calcium carbonate, and the like. Such a filler is contained in the base paper in a content ranging from 1 to 30 g/m$^2$, more preferably from 2 to 10 g/m$^2$ in terms of ash content.

Among the aforementioned fillers, calcium carbonate is particularly preferable because it gives satisfactory dot shape and sufficient color development.

The base paper used in the present invention is made by use of known necessary additives such as a papermaking auxiliary, a sizing agent, a yield-improving agent, a reinforcing agent, and the like.

In the use as ink-absorbent base paper, the basis weight of the base paper, which is an important factor having influence on the quality of printing, is preferably in the range of from 60 to 120 g/m$^2$. At the basis weight below 60 g/m$^2$, high-density printing causes problems of strike-through and cockling. On the contrary, at the basis weight above 120 g/m$^2$, the stiffness of the paper is excessively high to cause troubles in delivery in a recording apparatus.

In preparation of the recording medium of the present invention, the coating liquid containing the above-mentioned components is applied to the surface of a base material according to a known method such as the roll coater method, the blade coater method, the air-knife coater method, the gate roll coater method, the size press method, and the like. After the application of the aqueous coating liquid containing a pigment and a binder on a base material, the coating is dried by known drying methods such as hot-air drying. hot-drum drying, and the like to prepare the recording medium of the present invention.

A super calender treatment may be conducted in order to smoothen the surface of the ink receiving layer or to raise the surface strength of the ink-receiving layer.

Furthermore, the ink receiving layer in the present invention may contain a dye-fixing agent (water-resistance improving agent), a fluorescent brightener, a surfactant, an antifoaming agent, a pH-controlling agent, a mildew-proofing agent, a ultraviolet absorbing agent, an antioxidant, and the like, if necessary.

The method of the present invention is a recording method employing the above-mentioned recording medium of the present invention. In this method, the ink per se to be applied onto the specific recording medium by an ink-jet recording method may be a known ink. The recording agent, for example, may be a water-soluble dye such as a direct dye, an acidic dye, a basic dye, a reactive dye, a food dyestuff, and the like. Particularly suitable dyes for ink-jet recording, which gives images satisfying, in combination with the aforementioned recording medium, the required performances of fixing characteristics, color-developing characteristics, sharpness, stability, light-fastness, etc. of images, include direct dyes such as C.I. Direct Black 17, 19, 32, 51, 71, 108, and 146,
C.I. Direct Blue 6, 22, 25, 71, 86, 90, 106, and 199,
C.I. Direct Red 1, 4, 17, 28, and 83,
C.I. Direct Yellow 12, 24, 26, 86, 98, and 142,
C.I. Direct Orange 34, 39, 44, 46, and 60,
C.I. Direct Violet 47, and 48,
C.I. Direct Brown 109; and C.I. Direct Green 59;
acid dyes such as
C.I. Acid Black 2, 7, 24, 26, 31, 52, 63, 112, and 118,
C.I. Acid Blue 9, 22, 40, 59, 93, 102, 104, 113, 117, 120, 167, 229, and 234,
C.I. Acid Red 1, 6, 32, 37, 51, 52, 80, 85, 87, 92, 94, 115, 180, 256, 317, and 315,
C.I Acid Yellow 11, 17, 23, 25, 29, 42, 61, and 71,
C.I. Orange 7, and 19,
C.I. Acid Violet 49, and the like; and
C.I. Food Black 1, and 2.

The above dyes are particularly suitable ones for the ink for the recording method of the present invention, and the dyes for the present invention is not limited thereto.

Such a water soluble dye is used in a conventional ink at a concentration within the range of from about 0.1 to 20% by weight. In the present invention also, this concentration is acceptable.

The solvent used for the aqueous ink of the present invention may be water, or a mixed solvent comprising water and a water-soluble organic solvent. Particularly preferable are mixed solvents comprising water and a polyhydric alcohol as the water-soluble organic solvent exhibiting a dryness-preventing effect. The water is preferably deionized water, not usual water containing various ions.

The content of the water-soluble organic solvent in the ink is generally in the range of from 0 to 95% by weight, preferably from 2 tO 80% by weight, more preferably from 5 to 50% by weight of the total weight of the ink.

The ink employed in the present invention may contain a surfactant, a viscosity-controlling agent, surface-tension-controlling agent and the like in addition to the above-mentioned components.

Although any recording method may be employed for recording by application of the aforementioned ink in the method of the present invention, an ink-jet recording method is preferable which may be of any type capable of applying ink onto a recording medium (target) by releasing ink effectively from a nozzle.

In particular, the ink-jet recording method disclosed in Japanese Patent Application Laid-open No. 54-59936 is applicable successfully in which method the ink changes its volume abruptly by receiving thermal energy to be ejected from the nozzle by action of the change of the state.

In the present invention, since the coat layer is formed mainly of a porous inorganic pigment and additionally contains a water-insoluble amorphous basic aluminum salt as mentioned above, ink is rapidly absorbed into the interior of the coat layer, giving a sharp image with high-resolution without flow-out or running of ink even when different colors of inks are applied onto one spot in superposition within a short time. Furthermore, the resulting image is superior both in water-resistance and light-fastness. Accordingly, the recording medium is especially suitable for ink-jet recording.

The present invention is explained in more detail by referring to examples and comparative examples. The terms "parts" and "%" in the description are based on weight if not specially mentioned.

PREPARATION OF WATER-RESISTANCE IMPROVING AGENTS

Water-resistance improving agent 1

Approximately 12 liters of water and 1.6 kg of 5.18% hydrochloric acid solution were heated and stirred sufficiently. Thereto, 200 g of powdery aluminum was added portionwise over 3 hours at a reaction temperature of 80° C. or higher. The mixture was further maintained at a temperature between 90° C. and 105° C. for 21 hours to allow the reaction to proceed. Then the heating and stirring were stopped, and the reaction mixture was left standing for approximately 2 hours. Then the reaction mixture was subjected to centrifugation to eliminate the insoluble residue. The resulting dilute sol had a concentration of 2.2% in terms of $Al_2O_3$.

The resulting dilute sol was concentrated to a five-fold concentration by adding successively the dilute sol. Thereafter the concentrate was cooled to 35° C. in 3 hours, and water was added thereto with stirring to obtain a sol having a concentration of 10%.

The resulting particulate material was an aggregate of particles composed mainly of the polymer of $Al_3(OH)_8Cl$. The particles were amorphous, having no crystalline structure according to X-ray diffraction.

Water-resistance improving agent 2

In a manner similar to the case of Water-resistance improving agent 1, 1.1 kg of 5.18% hydrochloric acid was added to approximately 14 liters of water. Thereto 220 g of powdery aluminum was added at a temperature above 90° C. in 6 hours, and the reaction was further continued at a temperature between 90° C. and 105° C. for 26 hours. The reaction mixture was left standing for 12 hours, and the residue was removed therefrom, to obtain a sol having a concentration of 3% in terms of $Al_2O_3$. Further treatment was conducted in the same manner as in the case of Water-resistance improving agent 1 to obtain a sol of 10% concentration.

The resulting particles had the same shape as those of Water-resistance improving agent 1, and were amorphous particles composed mainly of the polymer of $Al_4(OH)_{11}Cl$.

Water-resistance improving agent 3

One liter of the sol of Water-resistance improving agent 1 was passed through an anion-exchange resin which had been treated with 10% acetic acid solution to obtain a sol of 10% concentration.

The resulting particulate material was composed mainly of a polymer of $Al_3(OH)_8 \cdot CH_3COO$, and the properties were the same as those of Water-resistance improving agent 1.

Water-resistance improving agent 4

To 1 kg of sodium aluminate solution having a concentration of 2.5%, 0.92 kg of aqueous 2.5% aluminum sulfate solution was added to form a slurry. The resulting slurry was heated to a temperature of 50° C., and was maintained at this temperature for an hour. The slurry was then filtered under reduced pressure, and washed to remove sodium sulfate.

To the resulting particulate material, nitric acid was added in an amount corresponding to $NO_3/Al$ molar ratio of 0.3. The mixture was boiled for one hour, and the concentration was adjusted so as to obtain a sol of 10% concentration.

The resulting particles were of nearly spheric shape, being composed mainly of boehmite (AlOOH) according to X-ray analysis.

Water-resistance improving agent 5

An aqueous 10% solution of a polyarylamine (trade name; PAA=10S; manufactured by Nittobo K.K.) was employed as a known amine type of water-resistance improving agent.

Water-resistance improving agent 6

Basic aluminum chloride solution commercially available with the trade name of PAC made by Taki Chemical Co., Ltd. was employed after adjusting the concentration to 10% in water, as an example of water soluble basic aluminum $[Al_2(OH)_1Cl_{6-1}]_m$.

Water-resistance improving agent 7

Ultra-fine particulate alumina (trade name; Aerosil Aluminum oxide-C; made by Degussa Co.) was employed after adjusting the concentration to a 10% slurry, as the representative example of crystalline alumina.

EXAMPLES 1-7, And COMPARATIVE EXAMPLES 1-5

The recording mediums of the Examples of the present invention and the Comparative examples shown in Table 1 were prepared by employing base papers having Stöckigt sizing degree of 5 seconds, a basis weight of 66 g/m², and an ash content of 9.0% (according to JIS-P-8128), applying the coating liquid shown below thereto so as to give dry coating of 5 g/m² by a bar-coater method, and drying them at 110° C. for 3 minutes.

| (Composition of Coating Liquid) | |
|---|---|
| Pigment | 100 parts |
| Polyvinyl alcohol (PVA-117/PVA-105 made by Kuraray Co., Ltd.) | 40 parts |
| Water-resistance improving agent (Solid content: 10%) | X parts |
| Water | (200 - X) parts |

TABLE 1

| | Pigment | Water-resistance improving agent No. | Quantity (X) | Stöckigt sizing degree of recording medium (sec.) |
|---|---|---|---|---|
| Example | | | | |
| 1 | Particulate aluminum oxide (AKP-G, made by Sumitomo Chemical Co., Ltd.) | 3 | 12 | 6 |
| 2 | Particulate aluminum oxide (AKP-G, made by Sumitomo Chemical Co., Ltd.) | 3 | 18 | 6 |
| 3 | Particulate aluminum oxide (AKP-G, made by Sumitomo Chemical Co., Ltd.) | 3 | 24 | 6 |
| 4 | Particulate aluminum oxide (Aerosil Aluminum Oxide-C) | 3 | 18 | 7 |
| 5 | Particulate aluminum oxide (AKP-G) | 1 | 18 | 6 |
| 6 | Particulate aluminum oxide (AKP-G) | 2 | 18 | 6 |
| 7 | Particulate magnesium oxide (MTK-30, made by Iwatani & Co., Ltd.) | 3 | 18 | 5 |
| Comparative Example | | | | |
| 1 | Particulate aluminum oxide (AKP-G) | — | 0 | 6 |
| 2 | Particulate aluminum oxide (AKP-G) | 4 | 18 | 6 |
| 3 | Particulate aluminum oxide (AKP-G) | 5 | 10 | 6 |
| 4 | Particulate aluminum oxide (AKP-G) | 6 | 18 | 6 |
| 5 | Particulate aluminum oxide (AKP-G) | 7 | 18 | 6 |

For evaluation of ink-jet-recording suitability of the above-described recording medium, ink-jet recording was conducted with an ink-jet printer, which has ink-jet heads for four colors of Y, M, C, Bk where each head has 128 nozzles with nozzle spacing of 16 nozzles per mm and ejects ink droplets by action of thermal energy, by use of the inks of the compositions below.

| Compositions of Ink (I) | |
|---|---|
| Dye | 5 parts |
| Diethylene glycol | 30 parts |

-continued

| | |
|---|---|
| Water | 68 parts |
| Dyes used in Ink I | |
| Y | C.I. Direct Yellow 86 |
| M | C.I. Acid Red 35 |
| Bk | C.I. Direct Blue 199 |
| C | C.I. Food black |

The evaluation was made regarding the times below. The results are shown in Table 2.

(1) The image density was evaluated by measuring the image density, with the Macbeth Densitometer RD-918, at a black portion of solid printing conducted with the ink-jet printer described above.

(2) The water-resistance [1] was evaluated by measuring the ratio (remaining O.D. rate) of the image density after immersion of the aforementioned print in flowing water at 20° C. for 5 minutes relative to that before the immersion.

(3) The water-resistance [2] was evaluated by attaching a water drop on a magenta portion of the print described above and wiping the water drop off after 30 seconds. The symbol ◎ denotes no residual mark of the water droplet being recognized, the symbol ○ denotes no flow of the dye into unprinted portion being recognized inspite of a residual mark of the water drop recognized, and the symbol x denotes flow-out of the dye being recognized.

(4) The light-fastness was evaluated by exposing the print prepared in the above item (1) with the xenon fade-meter (trade name; Ci-35; made by Atlas Co.) at a black panel temperature of 63° C. and a humidity of 70%RH for 100 hours, and measuring the difference of the chromaticity (CIE LAB) of before and after light exposure with the color analyzer (trade name; CA-35; made by Murakami Shikisai Kagaku K.K.)

TABLE 2

| | (1) Image density | (2) Water-resistance [1] (%) | (3) Water-resistance [2] | (4) Light-fastness (ΔE*) | (5) Remarks |
|---|---|---|---|---|---|
| Example | | | | | |
| 1 | 1.50 | 97 | ○ | 16.3 | |
| 2 | 1.51 | 101 | ○ | 17.3 | |
| 3 | 1.40 | 99 | ◎ | 20.1 | |
| 4 | 1.43 | 99 | ○ | 14.2 | |
| 5 | 1.51 | 100 | ○ | 23.2 | |
| 6 | 1.50 | 99 | ○ | 24.9 | Paint viscosity being high, Irregularity in coating |
| 7 | 1.34 | 100 | ○ | 17.0 | |
| Comparative Example | | | | | |
| 1 | 1.53 | 50 | X | 19.8 | |
| 2 | 1.51 | 48 | X | 24.4 | |
| 3 | 1.54 | 99 | ◎ | 50.7 | |
| 4 | 1.50 | 92 | X | 23.6 | |
| 5 | 1.48 | 48 | X | 22.4 | |

EXAMPLES 8–10 AND COMPARATIVE EXAMPLES 6–8

The samples of the present invention and for comparison were prepared with the materials shown in Table 3 for the cases of using a cationic pigment and the cases for using a conventional silica type pigment. The recording mediums were prepared in the same manner as in Example 1 except for the materials mentioned above. The evaluation was also made in the same manner as in Example 1. The results are shown in Table 4.

TABLE 3

| | | | | | Water-resistance improving agent No. | Quantity (X) | Stöckigt sizing degree of recording mediums (sec.) |
|---|---|---|---|---|---|---|---|
| Example | | | | | | | |
| 8 | Aluminum oxide (AKP-G) | 87 parts; | Silica (trade name; Finesil X-37; made by Tokuyama Soda Co.) | 13 parts | 3 | 18 | 6 |
| 9 | Aluminum oxide (AKP-G) | 50 parts; | Silica (trade name; Finesil X-37; made by Tokuyama Soda Co.) | 50 parts | 3 | 18 | 6 |
| 10 | Aluminum oxide (AKP-G) | 0 part; | Silica (trade name; Finesil X-37; made by Tokuyama Soda Co.) | 100 parts | 3 | 18 | 6 |
| Comparative Example | | | | | | | |
| 6 | Aluminum oxide (AKP-G) | 87 parts; | Silica (trade name; Finesil X-37; made by Tokuyama Soda Co.) | 13 parts | — | 0 | 6 |
| 7 | Aluminum oxide (AKP-G) | 50 parts; | Silica (trade name; Finesil X-37; made by Tokuyama Soda Co.) | 50 parts | — | 0 | 6 |
| 8 | Aluminum oxide (AKP-G) | 0 part; | Silica (trade name; Finesil X-37; made by Tokuyama Soda Co.) | 100 parts | — | 0 | 6 |

TABLE 4

| | (1) Image density | (2) Water-resistance [1] (%) | (3) Water-resistance [2] | (4) Light-fastness (ΔE*) |
|---|---|---|---|---|
| Example | | | | |
| 8 | 1.52 | 98 | ○ | 17.4 |
| 9 | 1.54 | 94 | X | 18.0 |
| 10 | 1.55 | 92 | X | 18.4 |
| Comparative Example | | | | |
| 6 | 1.53 | 40 | X | 16.7 |
| 7 | 1.53 | 26 | X | 17.2 |
| 8 | 1.56 | 18 | X | 17.6 |

We claim:

1. A recording medium comprising a substrate, and an ink-receiving layer provided thereon, said ink-receiving layer being a layer manually comprising a pigment, and said ink-receiving layer containing a water-insoluble and amorphous basic aluminum salt, wherein the amount of the basic aluminum salt is in a range of from 5 to 35 parts by weight per 100 parts by weight of pigment in the ink-receiving layer, and wherein the basic aluminum salt is represented by the general formula (1) below:

$$Al_x(OH)_yX_z \quad (1)$$

where x, y and z are respectively positive integers and satisfy the relations of $z=3x-y$, and $x/z \geqq 3$, and X is an acid radical.

2. A recording medium according to claim 1, wherein the basic aluminum salt forms an aggregate of particles mainly comprising the compound of the general formula (1).

3. The recording medium according to claim 1, wherein the acid radical X in the general formula (1) of the basic aluminum salt is an organic acid radical.

4. A recording medium comprising a base paper and a pigment layer provided thereon, said pigment layer containing a water-insoluble and amorphous basic aluminum salt, wherein the amount of the basic aluminum salt is in a range of from 5 to 35 parts by weight per 100 parts by weight of pigment in the pigment layer, wherein the basic aluminum salt is represented by the general formula (1) below:

$$Al_x(OH)_yX_Z \quad (1)$$

where x, y and z are respectively positive integers and satisfy the relations of $z=3x-y$, and $x/z \geqq 3$, and X is an acid radical, and said recording medium having a Stöckigt sizing degree of from zero to 15 seconds.

5. The recording medium according to claim 4, wherein the basic aluminum salt forms an aggregate of particles mainly comprising the compound of the general formula (1).

6. The recording medium according to claim 4, wherein the acid radical X in the general formula (1) of the basic aluminum salt is an organic acid radical.

7. The recording medium according to claim 4, wherein the pigment is a cationic pigment.

8. The recording medium according to claim 4, wherein the Stöckigt sizing degree of the base paper is in the range of from 0 to 15 seconds.

9. The recording medium according to claim 4, wherein the basis weight of the base paper is in the range of from 60 to 120 $g/m^2$.

* * * * *

UNITED STATES PATENT AND TRADEMARK OFFICE

CERTIFICATE OF CORRECTION

PATENT NO. : 5,182,175

DATED : January 26, 1993

INVENTOR(S) : Sakaki et al.

It is certified that error appears in the above-identified patent and that said Letters Patent is hereby corrected as shown below:

[57] ABSTRACT:

Line 4, "The" should read --In the--.

COLUMN 2:

Line 24, "Object" should read --object--.

COLUMN 3:

Line 31, "is" should read --are--.

COLUMN 4:

Line 23, insert -- where E: Streaming potential
P: Pressure to allow liquid to flow--.

COLUMN 5:

Line 19, "Of" should read --of--.

COLUMN 6:

Line 17, "of" should be deleted.
Line 23, "I5 seconds" should read --15 seconds--; and
Line 32, "the" (last occurrence) should read --in the--.

UNITED STATES PATENT AND TRADEMARK OFFICE

CERTIFICATE OF CORRECTION

PATENT NO. : 5,182,175

DATED : January 26, 1993

INVENTOR(S) : Sakaki et al.

It is certified that error appears in the above-identified patent and that said Letters Patent is hereby corrected as shown below:

COLUMN 7:

Line 7, "a" should read --an--;
Line 42, "is" should read --are--; and
Line 58, "tO" should read --to--.

COLUMN 11:

Line 45, "inspite" should read --in spite--.

COLUMN 13:

Line 20, "manually" should read --mainly--.

COLUMN 14:

Line 14, "$Al_x(OH)_yXZ$" should read --$Al_x(OH)_yX_z$--.

Signed and Sealed this

Eighth Day of February, 1994

Bruce Lehman

BRUCE LEHMAN

*Commissioner of Patents and Trademarks*

*Attest:*

*Attesting Officer*